US006796013B2

(12) United States Patent
Melker et al.

(10) Patent No.: US 6,796,013 B2
(45) Date of Patent: Sep. 28, 2004

(54) TOOLS FOR INSTALLATION AND REPAIR OF SPRINKLERS

(76) Inventors: Richard J. Melker, 6101 NW. 19th Pl., Gainesville, FL (US) 32605; Gary Matthew, 3632 NW. 31st Terr., Gainesville, FL (US) 32605

( * ) Notice: Subject to any disclaimer, the term of this patent is extended or adjusted under 35 U.S.C. 154(b) by 71 days.

(21) Appl. No.: 10/183,226

(22) Filed: Jun. 26, 2002

(65) Prior Publication Data

US 2004/0000052 A1 Jan. 1, 2004

(51) Int. Cl.[7] ..... B25B 7/02
(52) U.S. Cl. ..... 29/240
(58) Field of Search ..... 29/283.5, 240, 29/240.5, 456, 509, 520, 293, 577; 81/10

(56) References Cited

U.S. PATENT DOCUMENTS 3,731,364 A 5/1973 Romero
3,854,354 A * 12/1974 Angquist ..... 81/377
3,977,063 A 8/1976 Bruninga
4,085,633 A * 4/1978 Jackson et al. ..... 81/111
4,577,899 A 3/1986 Hemingway
4,583,275 A 4/1986 Diaz
4,730,773 A 3/1988 Meyer
4,788,894 A 12/1988 Mitschele
4,866,801 A 9/1989 Lamar
5,023,989 A 6/1991 Hargrave
5,037,238 A 8/1991 Wait
5,184,531 A 2/1993 Wickson
6,042,021 A 3/2000 Clark
6,234,411 B1 5/2001 Walker
6,487,942 B1 * 12/2002 Carter ..... 81/426.5

* cited by examiner

*Primary Examiner*—Robert C. Watson
(74) *Attorney, Agent, or Firm*—Saliwanchik, Lloyd & Saliwanchik

(57) ABSTRACT

Tools are provided for removing an inner tubular housing and/or outer casing of a pop-up sprinkler head and for purging an irrigation system of debris. The tools include a ring and disc used in conjunction to remove an inner tubular housing, a grooved cylinder and guide shaft used in conjunction to remove an outer casing, and the guide shaft and purge conduit with valve used in conjunction to purge an irrigation system.

8 Claims, 5 Drawing Sheets

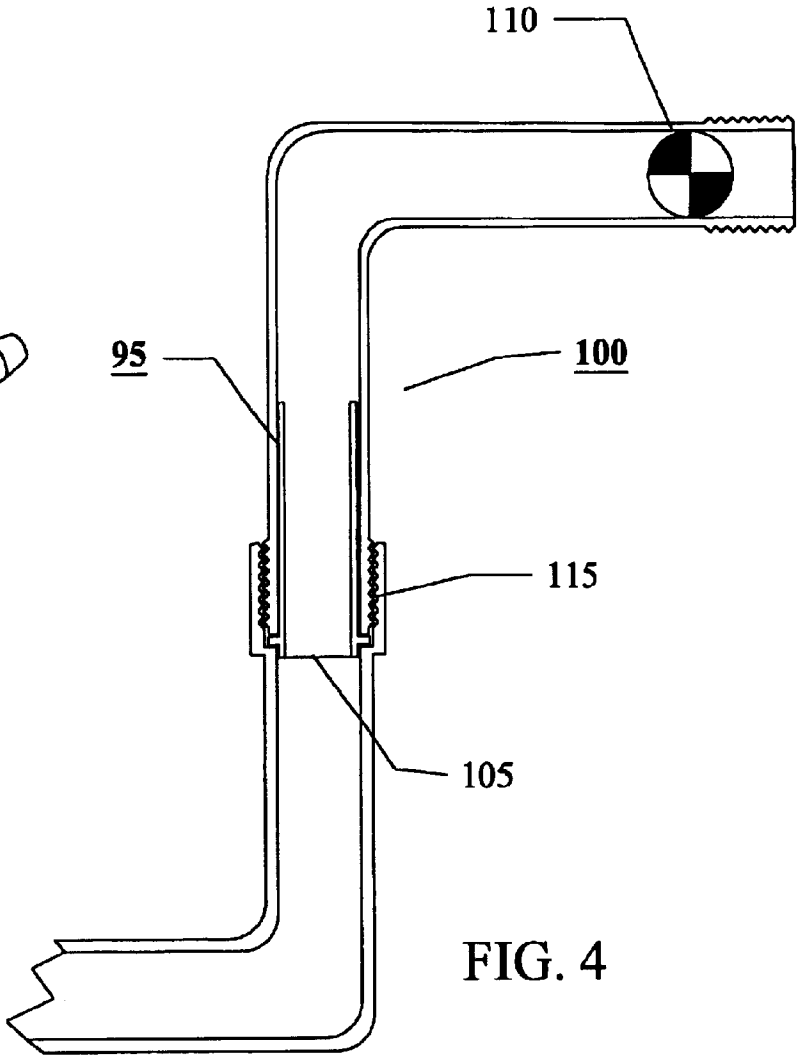
FIG. 4
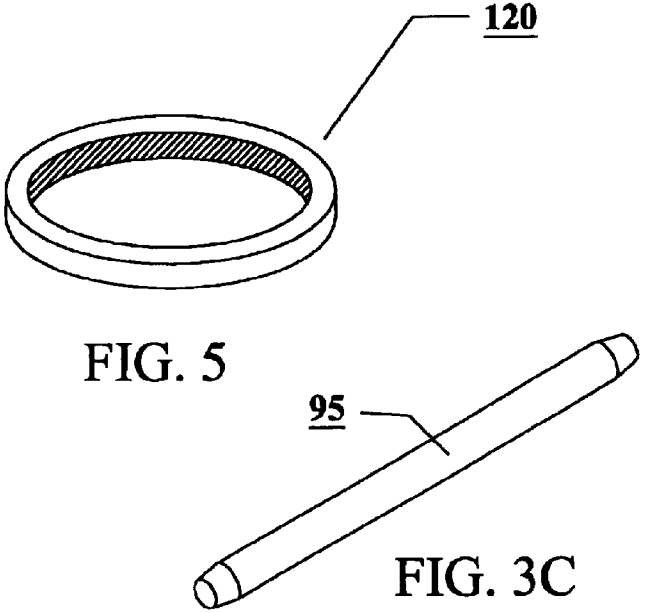
FIG. 5
FIG. 3C
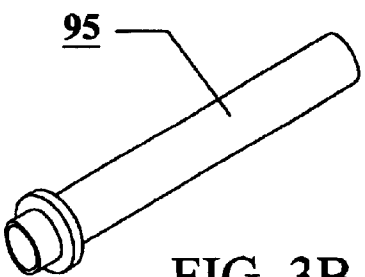
FIG. 3B

TOOLS FOR INSTALLATION AND REPAIR OF SPRINKLERS

BACKGROUND OF THE INVENTION

The present invention relates to tools for installing and repairing pop-up sprinkler units. In particular, the present invention relates to the installation, removal, repair, and/or replacement of the outer casing or the inner tubular housing of a pop-up sprinkler unit.

Current methods for watering lawns and gardens include underground irrigation systems with pop-up sprinkler units. Pop-up sprinkler units are particularly convenient because they are embedded in the ground when not in use. A pop-up rotary sprinkler unit typically includes a cylindrical outer casing, a cylindrical inner tubular housing concentrically mounted in the outer casing, and a threadably mounted retaining cap which secures the inner tubular housing in the outer casing. The retaining cap is detachably mounted by threads onto the outer casing.

The pop-up sprinkler unit is connected to a pressurized water supply line with a threaded riser located at the base of the sprinkler unit. The inner tubular housing extends upwardly from the outer casing when in operation due to hydraulic pressure provided when the pressurized water supply line is charged. The threadably mounted retaining cap holds the outer casing in relation to the inner tubular housing to allow the inner tubular housing to pop-up while being retained within the outer casing when the irrigation system is charged. The threadably mounted retaining cap is usually designed with numerous outwardly projecting threadably mounted retaining caps provided in order to gain purchase on the sprinkler unit. For examples of pop-up sprinklers of this general type, see U.S. Pat. Nos. 5,423,486 and 4,625,914.

At various times it may be desirable to remove either portions of the sprinkler unit individually or in combination, or the sprinkler unit in its entirety. Frequently, the seal between the inner tubular housing and the threadably mounted retaining cap becomes worn and the sprinkler leaks when the inner tubular housing is upwardly extended. It is desirable to replace the seal without having to remove the entire sprinkler unit. Removing the inner tubular housing while retaining the outer casing in the proper orientation on the threaded riser at its base involves unscrewing the threadably mounted retaining cap. Unfortunately, the tight friction fit between the threadably mounted retaining cap and the outer casing, as well as dirt, sand, organic debris, and soil on the threads of the outer casing, often result in the entire sprinkler unit rotating on the threaded riser. This results in the misalignment of the sprinkler, or as is often the case, the unintentional removal of the entire sprinkler unit.

Where grass has grown tightly around the sprinkler unit or where dirt has become compacted around the unit, it is often necessary to expand the hole in which the sprinkler unit is retained so that the sprinkler unit can be reattached to the threaded riser at the base. This damages the grass on the lawn, leaving it unsightly and necessitating sodding, seeding, and/or fertilization to induce re-growth of grass. Further, this process is extremely time consuming. Thus, there is a current need for a device to remove the threadably mounted retaining cap without turning or removing the outer casing.

Another problem encountered when initially installing sprinkler units, or when removing either the inner tubular housing or the entire sprinkler unit from the water supply for repair, is that loose soil, debris and rocks fall down into the piping system to contaminate and plug not only the piping system at that particular head but other inner tubular housings and sprinkler heads on the line. To ensure no loose debris or rocks remain in the piping system, the piping system is often purged before installing (or replacing) the sprinkler unit or the outer casing. Purging involves turning on the water system to flush debris from the piping, then shutting off the water supply and installing a sprinkler unit over the threaded riser connected to the irrigation system.

Purging is a time-consuming and messy process generally requiring two service people to manipulate the water supply and sprinkler, thereby making installment or repair of pop-up sprinkler units expensive. Purging is performed at the time of installation of the irrigation system, or when individual sprinkler units are replaced or serviced.

During initial installation, all sprinklers on a "line" must be installed and then the sprinklers individually removed with the system being turned on and then off between removal of each sprinkler on a line to be sure to flush all debris that has accumulated at that sprinkler has been removed. This must be done in a particular order starting with the sprinkler closest to the valve providing water to the system and proceeding to the furthest point in the system. In the case of a circle system where the zone is connected at both ends, the sprinklers must be individually removed starting at the end of the circle closest to the supply valve and moving from both sides to the sprinkler furthest away.

Purging is also a difficult problem when repairing or removing individual sprinkler units once a system has been installed. If the sprinkler unit is removed from the ground, debris including dirt, soil, sand, and grass fall into the hole from which the sprinkler is removed. These are very narrow and deep holes, making it extremely difficult to reattach the sprinkler unit without getting debris into the line and subsequently clogging the reinstalled sprinkler unit. Thus, before the sprinkler can be replaced, the irrigation line must be purged. Unfortunately, this fills the hole with water and results in additional debris in the line. It is extremely difficult to replace a sprinkler without contaminating the line and sprinkler unit with debris.

There are tools available to aid in removing pop-up sprinkler heads and inner tubular housings. One such tool compresses the ground around the sprinkler head to tightly grip the outer casing of the head so that it may be threadedly disengaged from the pressurized water supply line. See, for example, U.S. Pat. No. 4,788,894. Such tools, however, continue to damage and mar the lawn and allow loose soil fragments and rocks to contaminate the irrigation system. Other tools include a handheld tool for lifting an inner tubular housing to an extended position, where a sleeve is arranged for mounting and engaging the top of the inner tubular housing to facilitate lifting of the inner tubular housing. See U.S. Pat. No. 4,866,801. This tool does not effectively remove the inner tubular housing from the outer casing. U.S. Pat. Nos. 3,977,063 and 3,731,364 set forth further examples of sprinkler tool structures arranged for the maintenance of sprinkler systems. These tools are generally complex and impractical.

Therefore, there continues to be a need for new and improved tools to remove outer casings, inner tubular housings, and threadably mounted retaining caps of pop-up sprinkler units. The present invention overcomes these problems and disadvantages by providing tools for removing and installing the outer casing, inner tubular housing, and threadably mounted retaining cap of a pop-up sprinkler unit. The method of using the tools is simple and efficient while the tools themselves are easily manufactured.

BRIEF SUMMARY OF THE INVENTION

The present invention provides tools for installing, maintaining and/or repairing sprinkler systems. In a preferred embodiment, the tools of the subject invention are specifically adapted for use with in-ground sprinkler systems with sprinkler units having an outer casing, an inner tubular housing (concentrically mounted inside the outer casing), and a threadably mounted retaining cap. When the system is activated under hydraulic pressure, the inner tubular housing pops up out of the outer casing which remains firmly stationed in the ground. Advantageously, the tools of the subject invention can be used to easily and conveniently install, remove, and/or replace the inner tubular housings, the outer casings, and the seals of pop-up sprinkler units.

The tools and methods of the subject invention can be used by irrigation specialists who wish to increase their efficiency, prevent debris from entering the irrigation system, and/or reduce damage to lawns, shrubs, or decorative beds. The tools and procedures of the subject invention are also advantageous because they are so easy to use that an average homeowner, or other irrigation novice, can now readily change an entire sprinkler unit, or a component thereof, without contaminating the system with debris, damaging the sprinkler units, or digging up the lawn or flower beds.

In one embodiment, specifically exemplified herein, a ring and a disc are used in conjunction to remove a threadedly mounted retaining cap thereby making it possible to remove the inner tubular housing from the sprinkler unit. Advantageously, this can be done while leaving the outer casing in place. In a preferred embodiment of the subject invention, the ability to remove the inner tubular housing without simultaneously removing the outer housing arises from the ability to turn the retaining cap without simultaneously turning the outer casing. This is accomplished by pressing down on the inner tubular housing while turning the retaining cap. Because the inner tubular housing is engaged with the outer casing, the resistance to movement caused by pressing down on the inner tubular housing is transferred to the outer casing.

In a related embodiment, the subject invention further provides a tool which enhances the contact between the inner tubular housing and the outer casing. This tool, according to the present invention, includes a deformable ring that can be inserted into the interior of the outer casing. Therefore, when torque is applied to unscrew the retaining cap the ability to prevent turning of the outer casing by applying pressure to the inner tubular housing is improved.

In another embodiment, a grooved cylinder is used to remove the outer casing of a sprinkler unit. The outer casing may be attached to the irrigation line with the help of a guide shaft that can be used to direct the outer casing to the proper location while preventing debris from entering the system. The grooved cylinder may have an interior housing to accommodate the guide shaft. In yet another embodiment, a hollow purge conduit, optionally with a valve, can be used to purge the irrigation system.

Specifically exemplified herein is a ring, having at least one tooth, to engage at least one flange located on the threadably mounted retaining cap of a typical pop-up sprinkler unit. The ring is used to unscrew the threadably mounted retainer cap from the outer casing. Once the retainer cap is unscrewed, the inner tubular housing can be removed thereby exposing the seal.

In order to unscrew the threadably mounted retaining cap, it is necessary to keep the outer casing from turning. As described herein, the disc of the subject invention preferably includes at least one leg to fit at least one aperture at the top of the inner tubular housing. By pressing down on the disk it is possible to keep the outer casing from turning.

In a method of use, the ring is fitted over the threadably mounted retaining cap at the top of the inner tubular housing with at least one tooth inserted into at least one notch on the threadably mounted retaining cap. The disc is then placed over the top of the inner tubular housing with at least one leg inserted into an aperture thereof. The inner tubular housing can then be removed by first pressing down on the disc to ensure the outer casing does not move with the threadably mounted retaining cap while turning the ring in a counterclockwise direction to unscrew the threadably mounted retaining cap from the outer casing.

Once the threadably mounted retaining cap is no longer threadedly attached to the outer casing, the inner tubular housing may then be easily lifted and removed from the outer casing to either replace or repair components of the inner tubular housing including, for example, the seal between the inner tubular housing and the threadably mounted retaining cap.

Once the inner tubular housing has been removed, if desired, the outer casing may then be removed using the casing-remover of the subject invention. This casing-remover is, preferably, a grooved cylinder. The grooved cylinder preferably has at least one vertical groove corresponding to a vertically aligned fin located in the interior of the outer casing. The outer casing may be removed by aligning the fin located within the interior of the outer casing with the vertical groove of the cylinder, and inserting the cylinder into the outer casing. The cylinder is then rotated counterclockwise to detach the outer casing from the fitting of the irrigation system. The outer casing can then be replaced with the help of a guide shaft which can be inserted into the irrigation system to align the outer casing to the proper location and prevent debris from entering the system. An embodiment of the present invention provides a hollow guide shaft that may be retained in a purge conduit.

Should any debris fall into the irrigation system after removal, or before installation, of a sprinkler unit, the purge conduit of the subject invention can be inserted into the opening of the pressurized water system, over the guide shaft. A valve attached at the top of the conduit is set in the closed position. The irrigation system is turned on and the valve is opened to allow purging. Once complete, the valve is closed. This process may be repeated as necessary for each sprinkler unit in an irrigation system.

To re-attach the sprinkler unit to the irrigation system, the purge conduit is rotated counterclockwise and unscrewed from the threaded riser connected to the irrigation system. The outer casing can then be fitted over the guide shaft and rotated in a clockwise fashion to re-attach the outer casing to the system.

In one embodiment, the subject invention provides tool sets, each of which comprises at least two tools which can be used together to remove one or more components of a sprinkler unit and/or assist in purging the irrigation system.

BRIEF DESCRIPTION OF DRAWINGS

FIG. 3B is a perspective view of a hollow guide shaft to be used in conjunction with the grooved cylinder of FIG. 3A and with the outer pipe of FIG. 4.

FIG. 3C is a perspective view of a non-hollow guide shaft according to the present invention.

FIG. 4 is a perspective view of a purge conduit to be used in removing loose soil and rocks from an irrigation system.

FIG. 5 is a perspective view of a deformable ring for enhancing the contact between the inner tubular housing and the outer casing.

DETAILED DISCLOSURE OF THE INVENTION

Figure 1A:
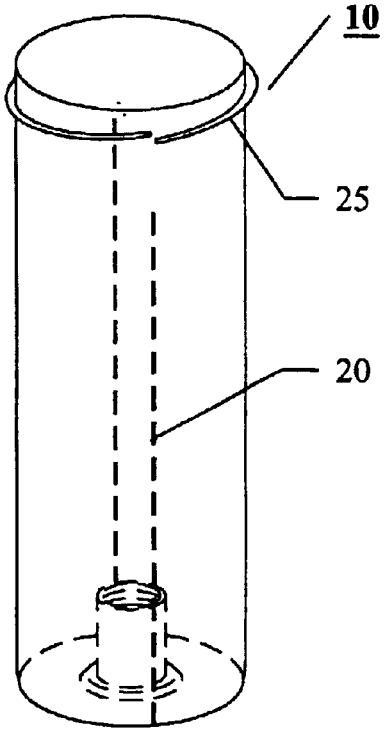
FIGS. 1A and 1B illustrate a perspective view of an outer casing of a typical pop-up sprinkler.

The present invention provides materials and methods for installing, maintaining and/or repairing the sprinkler units of pop-up sprinkler systems. In a preferred embodiment, the tools of the subject invention are specifically adapted for use with in-ground sprinkler units with inner tubular housings that pop-up out of the ground when the system is activated under hydraulic pressure. Advantageously, the tools of the subject invention can be used to easily and conveniently install and/or remove the inner tubular housings, the outer casings, and the seals of pop-up sprinkler units. The subject invention further provides components for purging the irrigation system to remove debris conveniently while minimizing mud formation around the sprinkler unit.

The tools and procedures of the subject invention are specifically and uniquely designed to facilitate any or all of the following: (1) removal and replacement of the inner tubular housing or seals of a sprinkler unit while leaving the outer casing in place, (2) removal and replacement of the outer casing of a sprinkler unit, (3) removal or replacement of an entire sprinkler unit, and/or (4) purging of the irrigation system. These objectives are achieved by the unique ability of these tools to isolate particular components of the system for easy manipulation.

Thus, for example, in one embodiment, the tools are designed to hold the outer casing in place while the retaining cap is unscrewed and the inner tubular housing is removed. The easy removal of the inner tubular housing is facilitated by the unique design of the tools according to the present invention which enable the operator to apply sufficient manual torque to unscrew the threadably mounted retaining cap which holds the inner tubular housing in place. In the past this has been a considerable challenge due to the shape and configuration of the threadably mounted retaining cap as well as the inability to hold the outer case in place while turning the retaining cap.

The ability to apply torque to the threadably mounted retaining cap while preventing, or reducing, any turning of the outer casing is achieved using a first tool for engaging and turning the threadably mounted retaining cap and a second tool for resisting movement of the outer casing. The torque-applying tool may be, for example, a ring which provides sufficient, and readily accessible, surface area so that the user may grasp and turn the tool. The torque generated by turning the ring is transferred to the threadably mounted retaining cap by an engagement means which engages the threadably mounted retaining cap without engaging the outer casing. In a preferred embodiment, which is specifically exemplified herein, the ring of the subject invention has at least one tooth to engage the threadably mounted retaining cap which secures the inner tubular housing to the outer casing. This threadably mounted retaining cap is secured to the inner tubular housing such that unscrewing the threadably mounted retaining cap facilitates removal of the inner tubular housing from the outer casing.

In practice, torque applied on the threadably mounted retaining cap is often transferred to the outer casing. This is why it is difficult to remove the inner tubular housing without also removing the outer casing. Therefore, although the first torque-applying tool is a critical component of the tool set of the subject invention, a second tool which holds the outer casing in place is also advantageous. In a preferred embodiment, this second tool is a disc that engages the top of the inner tubular housing. The use of these two tools in conjunction makes it possible to unscrew the threadably mounted retaining cap to remove the inner tubular housing without simultaneously unscrewing (or breaking off) the outer casing. Thus, repairs and/or replacement of components located on or within the inner tubular housing, such as the seal between the inner tubular housing and the threadably mounted retaining cap, may be performed without having to remove an entire sprinkler unit.

In a preferred embodiment specifically exemplified herein, the disc includes at least one leg to fit at least one aperture at the top of the sprinkler unit. The disc can also have holes, or recessions, to accommodate protrusion(s) which may exist at the top of the sprinkler unit. The disc also has sufficient surface area to facilitate grasping and holding (preventing rotation) of the disc. This prevents rotation of the outer casing.

The ability of the second tool to prevent rotation of the outer casing arises due to the contact between the inner tubular housing and the outer casing. In certain instances, the strength of this contact is insufficient and the outer casing can turn even if the inner tubular housing is prevented from turning. Therefore, another aspect of the subject invention concerns a third tool that enhances the second tool's ability to resist movement of the outer casing when torque is applied on the threadably mounted retaining cap. In a preferred embodiment, the third tool is a deformable ring that is inserted into the interior bottom of the outer casing to increase contact between the inner tubular housing and the outer casing. Preferably the third tool is inserted into the outer casing during installation of the sprinkler unit or during any instance in which the inner tubular housing is removed from the outer casing. The deformable ring may be composed of a variety of known materials including, for example, plastic, rubber, and the like. Accordingly, upon insertion of the third tool, a stronger engagement exists between the outer casing and the inner tubular housing and, consequently, the ring and disc are more effective in removing the retaining cap without turning the outer casing.

A further aspect of the subject invention is a tool which can be used to remove the outer casing once the inner tubular housing has been removed. This tool is specifically designed to apply torque in order to unscrew the outer casing from the threaded riser connected to an irrigation pipe. In a preferred embodiment, this is achieved through the use of a grooved cylinder that can be lowered into the internal cavity of the outer casing (once the inner tubular housing has been removed). The grooved cylinder has, preferably running its length, at least one groove to engage at least one vertical fin which is typically present on the inside surface of the outer casing of a standard pop-up sprinkler unit. Thus, the grooved cylinder has a vertical groove corresponding to a vertically aligned fin located in the interior of the outer casing.

In one embodiment, the grooved cylinder is hollow and has an interior housing to longitudinally accommodate a guide shaft for projection into the threaded riser connected to the pressurized water system. To facilitate the easy attachment of the outer casing to the threaded riser connected to the irrigation system, the guide shaft can be used to align the outer casing to the threaded riser. According to the present invention, the guide shaft may be hollow.

In a preferred embodiment of the subject invention, the purge conduit is used to conveniently remove debris from the irrigation system by directing water (and debris) out of the system, from the site of the removed inner tubular housing, and directing the water a sufficient distance from the site of the sprinkler unit so that water does not pool around the unit. This minimizes mud and mess.

In order to facilitate the easy placement and attachment of the outer casing at the threaded riser connected to the irrigation system, a guide shaft having an outer diameter less than the inner diameter of the threaded riser can be inserted into the opening of the riser. The outer casing can then be slid over the guide shaft so that it fits conveniently over threaded riser. The outer casing can then be threadedly engaged to the irrigation system via the riser, and the guide shaft is then removed. In a preferred embodiment, the purge conduit is simply a portion of PVC piping, or even a hose, which conveys the water away from the immediate vicinity of the sprinkler unit. Typically, the purge conduit is threadedly engaged to the threaded riser connected to the irrigation system where the outer casing has been removed. In a specific embodiment, the purge conduit has a valve to permit controlled purging of the irrigation system.

In a method of use, the ring is fitted over the threadably mounted retaining cap of a sprinkler unit with a tooth inserted into a notch on a flange located on the threadably mounted retaining cap and the disc is placed over the top of the inner tubular housing with at least one leg inserted into an aperture thereof. The inner tubular housing can then be removed by pressing down on the disc. A toothed flange located at the bottom of the inner tubular housing is engaged with the vertical fin on the inside of the outer casing. Pressing down on the disc ensures the outer casing does not move with resisting force being applied from the disc, through the inner tubular housing to the flange located at the bottom of the inner tubular housing. The flange located at the bottom of the inner tubular housing engages at least one fin on the interior of the outer casing. Thus, resistance force applied through the flange located at the bottom of the inner tubular housing is transferred to at least one fin of the outer casing to oppose the torque applied by the ring in a counterclockwise direction to unscrew the threadably mounted retaining cap from the outer casing of the sprinkler unit.

To further enhance the resistance force applied from the disc, a third tool may be inserted into the interior bottom of the outer casing to strengthen the engagement between the flange located at the bottom of the inner tubular housing and at least one fin on the interior of the outer casing. In an embodiment, a deformable ring is placed into the interior bottom of the outer casing during the installation of the sprinkler system. Once the threadably mounted retaining cap is no longer threadedly attached to the outer casing, the inner tubular housing may then be easily lifted and removed from the outer casing. This facilitates replacement of the annular seal assembly as well as the inner tubular housing.

Once the inner tubular housing has been removed, if desired, the outer casing may then be removed by aligning the fin located within the interior of the outer casing with the vertical groove of the grooved cylinder, and inserting the grooved cylinder into the outer casing. The guide shaft can then be inserted into the interior housing of the grooved cylinder and inserted into the opening of the threaded riser connected to the pressurized water system. The guide shaft may be hollow so as to accommodate system purging. The grooved cylinder is then rotated counterclockwise to detach the outer casing from the threaded riser.

Should any debris fall into the irrigation system after removal and/or before installation of a sprinkler unit, the purge conduit can be used to remove the debris. The purge conduit is, optionally, threadedly attached to the pressurized water system at the threaded riser, over the guide shaft. Initially, a valve attached at the top of the purge conduit is set in the closed position. The irrigation system is turned on and then the valve is opened to allow purging. The purge conduit directs the water (and debris from within the system) away from the immediate vicinity of the sprinkler unit. In an alternative embodiment, a cap is used rather than a valve for the purge conduit. To purge the system, the cap may be removed and once purging is completed, re-screwed back into place on the purge conduit. An alternative embodiment can include a slidable handle bar attached to the top of the purge conduit. Once purging is complete, the valve is closed. This process may be repeated as necessary for every sprinkler unit in an irrigation system.

To re-attach the sprinkler unit to the water system, the purge conduit is rotated counterclockwise and unscrewed from the threaded riser connected to the water pressure. The outer casing is then fitted over the guide shaft and rotated in a clockwise fashion to re-attach the casing to the threaded riser connected to the water system.

All patents, patent applications, provisional applications, and publications referred to or cited herein are incorporated by reference in their entirety, including all figures and tables, to the extent they are not inconsistent with the explicit teachings of this specification.

Following are examples which illustrate procedures for practicing the invention. These examples should not be construed as limiting.

EXAMPLE 1

Removal of an Inner Tubular Housing

Figure 1D:
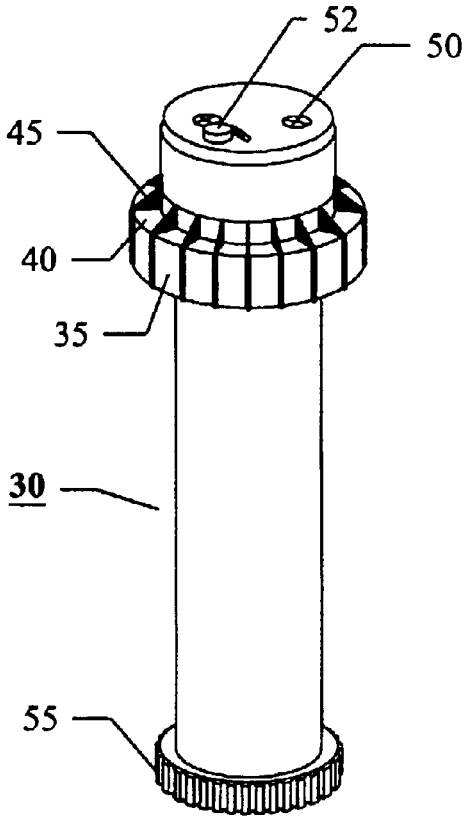
FIGS. 1C and 1D are perspective views of an inner tubular housing.
Figure 1B:
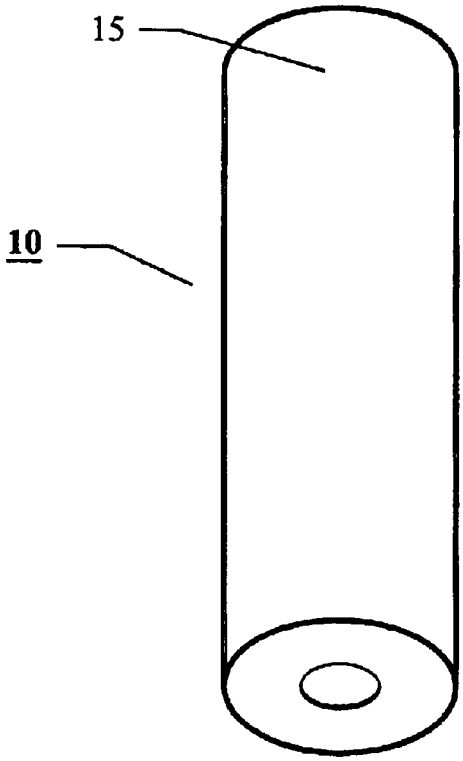

FIGS. 1A, 1B, 1C, and 1D illustrate typical components of a pop-up sprinkler unit. FIGS. 1A and 1B illustrate the cylindrical outer casing 10 of a pop-up sprinkler unit. The outer casing 10 includes a female threaded lower end 15 that screws over a male threaded riser (not shown) connected to a pressurized water supply line. Within the interior of the outer casing 10 there is at least one vertically aligned fin 20. The exterior rim of the outer casing 10 is threaded 25.

Figure 1C:
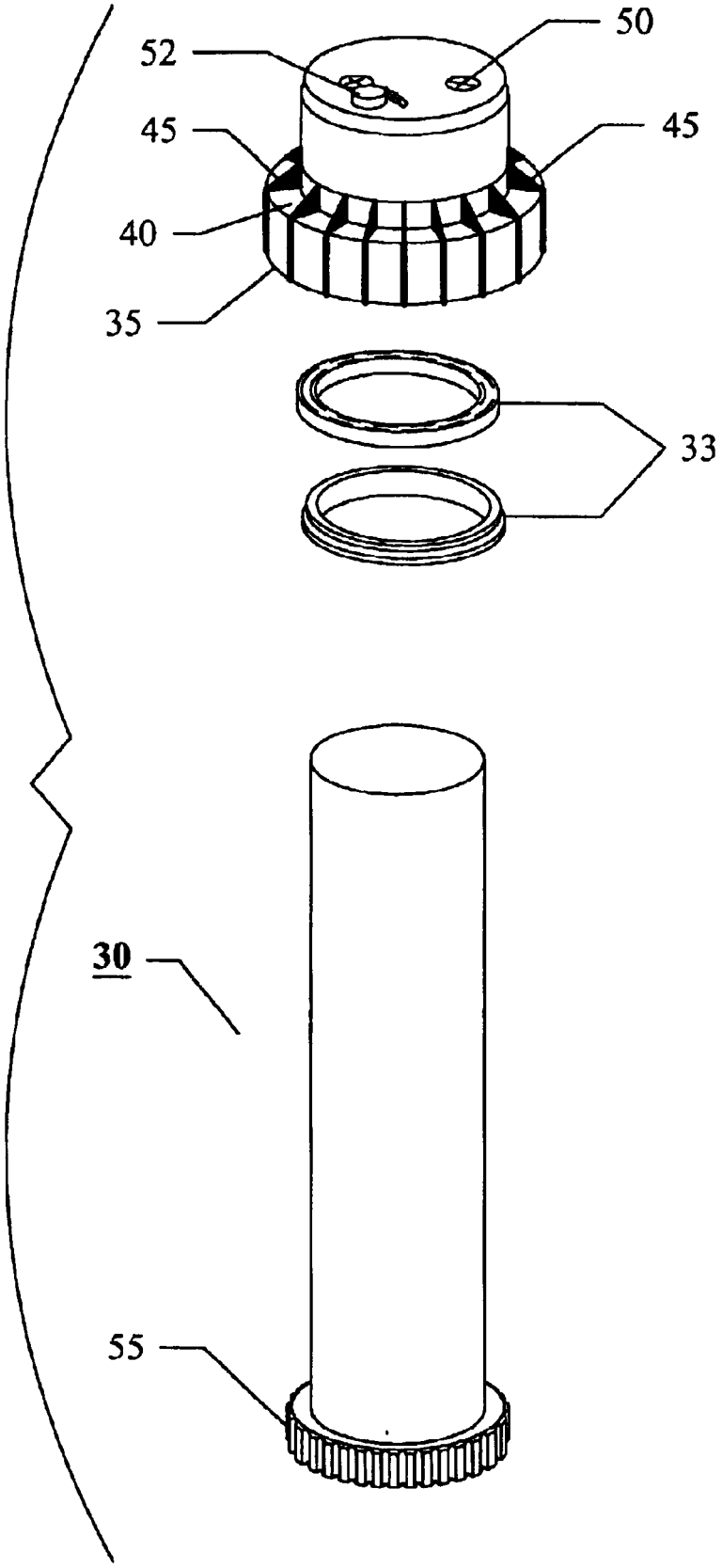

FIGS. 1C and 1D illustrate an inner tubular housing 30 mounted concentrically within the outer casing 10. The inner tubular housing 30 extends upwardly from the outer casing 10 when in operation due to hydraulic pressure provided when the pressurized water supply line is charged. Detachably seated around the top wall of the inner tubular housing 30 are an annular seal assembly 33 and a radially, outwardly projecting, threadably mounted retaining cap 35 with notches 40 formed by flanges 45 at the peripheral margin of the threadably mounted retaining cap 35. At the top of the inner tubular housing 30 are at least one aperture 50 and at least one protrusion 52. The aperture 50 is typically for access to spray and nozzle adjustment and the protrusion 52 typically identifies where the spray opening is located. The projecting threadably mounted retaining cap 35 is threaded beneath (not shown) to screw over the threaded 25 rim of the outer casing 10. The inner tubular housing 30 also includes at the bottom, a toothed flange 55 to engage the vertically aligned fin 20 within the interior of the outer casing 10.

Figure 2B:
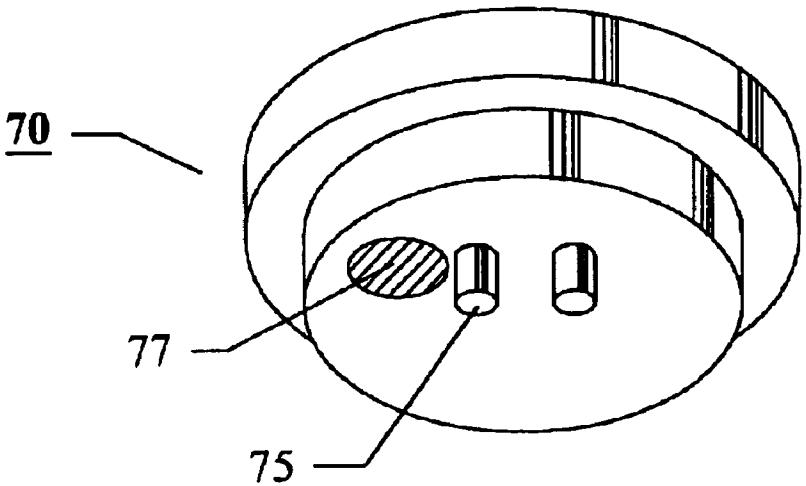
FIG. 2B is a perspective view of a top disc to be used in conjunction with the ring of FIG. 2A.
Figure 2A:
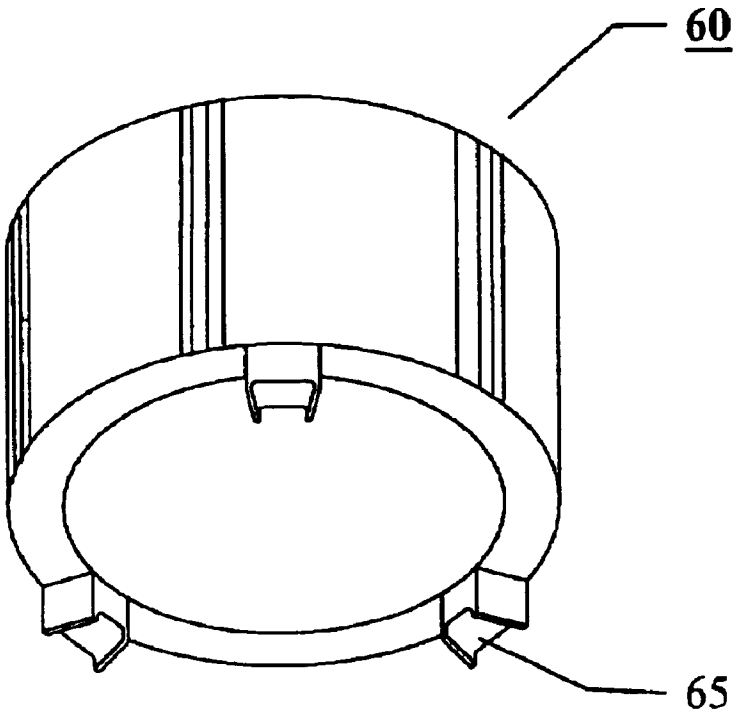
FIG. 2A is a perspective view of a ring of the subject invention for removing the inner tubular housing of a pop-up sprinkler unit.

Referring to FIGS. 2A and 2B, the tool of the subject invention for removing an inner tubular housing 30 involves a ring 60 having at least one tooth 65 extending out of the bottom of the ring 60 and a disc 70 to be placed at the top of an inner tubular housing. The disc 70 includes at least one leg 75 connected to the bottom of the disc 70. The disc 70 also includes at least one hole 77 to accommodate the protrusion(s) 52. The tooth 65 of the ring 60 engages (refer to FIG. 1C) notches 40 formed by flanges 45 at the peripheral margin of the projecting threadably mounted retaining cap 35 around the top of the inner tubular housing 30. At least one leg 75 of the disc 70 can be inserted through at least one aperture 50 in the top of an inner tubular housing 30. When at least one leg 75 of the disc 70 is inserted in the top of the inner tubular housing 30, at least on hole 77 fits over any protrusion(s) 52 also located at the top of the inner tubular housing 30.

In a preferred embodiment, removal of the inner tubular housing is accomplished by: (1) mounting the ring 60 onto the threadably mounted retaining cap 35 by engaging a tooth 65 into notches 40 formed by flanges 45 on the threadably mounted retaining cap 35, (2) placing the disc 70 on top of the inner tubular housing 30, (3) inserting the leg(s) 75 and fitting the hole(s) 77 of the disc 70 through aperture(s) 50 and over the protrusion(s) 52 located at the top of the inner tubular housing 30, respectively, (4) maintaining sufficient force on the disc 70 to restrict movement of the outer casing 10 by ensuring the flange 55 located at the bottom of the inner tubular housing 30 engages the vertical fin 20 of the outer casing to restrain movement of the outer casing 10 and (5) manually twisting the ring 60 counterclockwise until the threadably mounted retaining cap 35 is disengaged from the threaded exterior rim 25 of the outer casing 10 of the pop-up sprinkler unit. Once the inner tubular housing 30 is removed from the outer casing 10, repair and/or replacement of components such as the annular seal assembly 33 may be performed.

EXAMPLE 2

Removal of Outer Casing

Figure 3A:
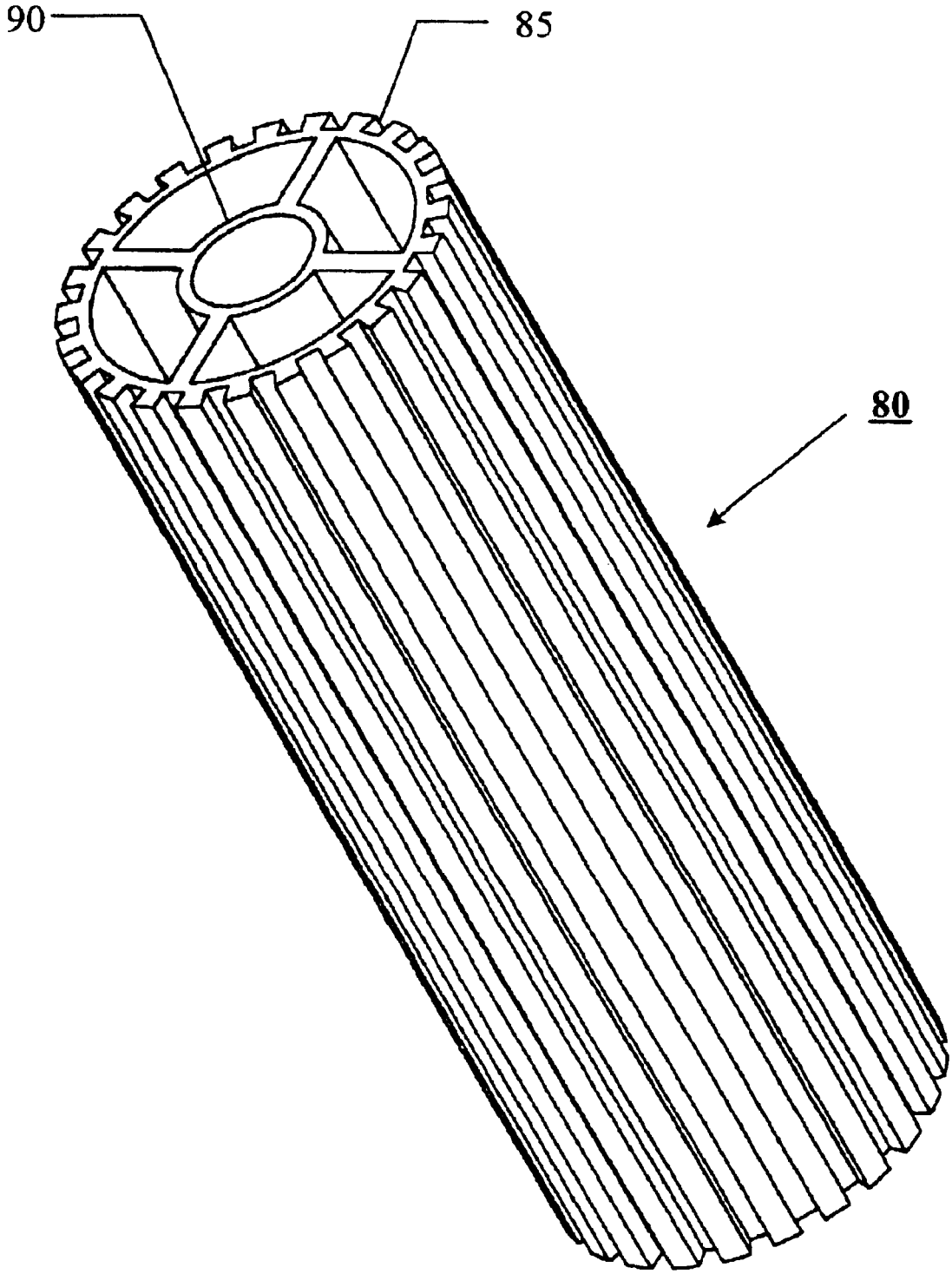
FIG. 3A is a perspective view of a grooved cylinder for removing the outer casing of a pop-up sprinkler unit.

A tool, according to the subject invention, for removing the outer casing 10 of a pop-up sprinkler unit is illustrated in FIGS. 3A, 3B, and 3C. A grooved cylinder 80 has at least one vertical groove 85 located on the exterior of the grooved cylinder 80 to engage (refer to FIG. 1A) at least one vertically aligned fin 20 within the interior of the outer casing 10. The grooved cylinder 80 can also include an interior housing 90 to longitudinally accommodate a guide shaft 95 for projection into a threaded riser connected to the pressurized water system (not shown). In this manner, the guide shaft 95 is arranged for deflecting any loose soil fragments or rocks from falling into and plugging the piping system.

Removal of an outer casing 10 for a pop-up sprinkler unit is accomplished by: (1) inserting the grooved cylinder 80 into the outer casing 10 of a pop-up sprinkler unit by slidably aligning a fin 20 within the interior of the outer casing 10 with a groove 85 of the grooved cylinder 80, (2) inserting the guide shaft 95 into the interior housing 90 and ensuring the guide shaft 95 is projecting into the threaded riser connected to the outer casing 10, and (3) turning the grooved cylinder 80 counterclockwise to remove the outer casing 10 from the threaded riser.

EXAMPLE 3

Purging the System

To ensure that no loose dirt or rocks contaminate the irrigation system, the present invention includes a purging tool as illustrated in FIG. 4. The purging tool includes the purge conduit 100, the purge conduit 100 being placed over guide shaft 95 and threadedly attached at the bottom 105 to the threaded riser 115 connected to the pressurized water supply. The purge conduit 100 must be of sufficient length to have one end above ground when inserted into the threaded riser. In a preferred embodiment, the purge conduit 100 has a valve 110 at its end above ground. Several purging tools may be installed throughout the irrigation system when decontaminating the system of loose soil and debris.

To clear a system of debris the valve 110 at the end of purge conduit 100 is closed and the water for the irrigation system is turned on. Once the irrigation system is charged, the valve 110 is opened to purge the specific site on the irrigation system. Once the system is purged, the water may be turned off.

The purge conduit 100 may then be removed. Then, the outer casing 10 of the sprinkler unit may be attached to the water pressurized system without having any loose soil or rocks contaminating the system by inserting the guide shaft 95 through the bottom opening 15 of the outer casing 10 and threadedly attaching the casing 10 to the threaded riser connected to the pressurized water supply.

EXAMPLE 4

Tool Sets

In one embodiment, the subject invention provides the tool sets for removing, replacing and/or installing various components of the heads of pop-up sprinkler systems.

Thus, in one embodiment, the subject invention provides a tool set for removing an inner tubular housing from an outer casing of a pop-up sprinkler unit wherein the sprinkler unit has a threadably mounted retaining cap with at least one notch and an inner tubular housing having at least one aperture; wherein said tool set comprises:

a) a ring comprising at least one tooth for engaging a notch of the threadably mounted retaining cap; and b) a disc comprising a leg for insertion through an aperture in the top of the inner tubular housing.

In a related embodiment of the tool set for removing an inner tubular housing from an outer casing, a new annular seal assembly is provided to replace worn seals.

A further embodiment of the tool set for removing an inner tubular housing from an outer casing, as illustrated in FIG. 5, includes a means for strengthening the connection between the inner tubular housing and the outer casing. A deformable ring 120 can be placed into the interior bottom of an outer casing 10. Upon insertion of an inner tubular housing 30 into an outer casing 10, the flange 55 located at the bottom of the inner tubular housing 30 compresses and deforms ring 120 to enhance the contact between the flange 55 and the vertical fin 20 of the outer casing 10.

The subject invention also provides a tool set for removing an outer casing of a pop-up sprinkler unit comprising:

a) a grooved cylinder comprising at least one vertically aligned groove located on the exterior of the grooved cylinder; and b) a guide shaft.

In a further embodiment, the subject invention provides a tool set for purging an irrigation system and for installing a pop-up sprinkler head comprising:

a) a purge conduit.

Each of the tool sets of the subject invention can further comprise tools from the other sets. Also, preferably the tool sets of the subject invention are accompanied by instructions for using the tools to install and/or replace sprinkler heads, or components thereof.

It should be understood that the examples and embodiments described herein are for illustrative purposes only and that various modifications or changes in light thereof will be suggested to persons skilled in the art and are to be included within the spirit and purview of this application.

We claim:

1. A tool set for performing work on an in-ground sprinkler unit wherein said sprinkler unit comprises an inner tubular housing and an outer casing, wherein the inner tubular housing is detachably secured to the outer casing by a threadably mounted retaining cap, wherein the threadably mounted retaining cap comprises at least one notch, wherein the tool set comprises:

a) a first tool which engages and can turn the threadably mounted retaining cap of the in-ground sprinkler unit wherein the first tool is a ring comprising at least one tooth for engaging a notch of the threadably mounted retaining cap; and b) a second tool for applying force to the inner tubular housing of the in-ground sprinkler unit to resist movement of the inner tubular housing when the retaining cap is turned.

2. A tool set for performing work on an in-ground sprinkler unit wherein said sprinkler unit comprises an inner tubular housing and an outer casing, wherein the inner tubular housing is detachably secured to the outer casing by a threadably mounted retaining cap, wherein the inner tubular housing comprises at least one aperture located at the top of the inner tubular housing, wherein the tool set comprises:

a) a first tool which engages and can turn the threadably mounted retaining cap of the in-ground sprinkler unit; and b) a second tool for applying force to the inner tubular housing of the in-ground sprinkler unit to resist movement of the inner tubular housing when the retaining cap is turned, wherein the second tool is a disc comprising at least one leg for insertion into an aperture located at the top of the inner tubular housing.

3. A tool set for performing work on an in-ground sprinkler unit wherein said sprinkler unit comprises an inner tubular housing and an outer casings wherein the inner tubular housing is detachable secured to the outer casing by a threadably mounted retaining cap, wherein the inner tubular housing comprises a flange at the bottom of the inner tubular housing that engages at least one vertically aligned fin located within the interior of the outer casing; wherein the tool set comprises:

a) a first tool which engages and can turn the threadably mounted retaining cap of the in-ground sprinkler unit;

b) a second tool for applying force to the inner tubular housing of the in-ground sprinkler unit to resist movement of the inner tubular housing when the retaining cap is turned; and c) a device which strengthens the engagement between the flange at the bottom of the inner tubular housing and a fin located within the interior of the outer casing.

4. A tool set for performing work on an in-ground sprinkler unit wherein said sprinkler unit comprises an inner tubular housing and an outer casing, wherein the inner tubular housing is detachably secured to the outer casing by a threadably mounted retaining cap; wherein the tool set comprises:

a) a first tool which engages and can turn the threadably mounted retaining cap of the in-ground sprinkler unit;

b) a second tool for applying force to the inner tubular housing of the in-ground sprinkler unit to resist movement of the inner tubular housing when the retaining cap is turned; and c) a third tool for removing the outer casing of the in-ground sprinkler-unit, wherein the outer casing comprises at least one vertically aligned fin located in the interior of the outer casing, wherein said third tool engages a vertically aligned fin such that the outer casing can be turned by turning said tool.

5. The tool set, according to claim 4, wherein said third tool is a grooved cylinder.

6. The tool set according to claim 1, which further comprises a guide shaft for aligning the outer casing on a riser of an irrigation system.

7. The tool set according to claim 6, which further comprises a third tool for purging the irrigation system wherein said third tool comprises a purge conduit for directing water away from the in-ground sprinkler unit.

8. The tool set according to claim 7, wherein the purge conduit comprises a valve.

* * * * *